US006769683B2

(12) United States Patent
Hiramatsu

(10) Patent No.: US 6,769,683 B2
(45) Date of Patent: Aug. 3, 2004

(54) IMAGE RECORDING APPARATUS

(75) Inventor: Soichi Hiramatsu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/100,914

(22) Filed: Mar. 20, 2002

(65) Prior Publication Data

US 2002/0135122 A1 Sep. 26, 2002

(30) Foreign Application Priority Data

Mar. 23, 2001 (JP) ..... 2001-085422

(51) Int. Cl.[7] ..... B65H 5/06
(52) U.S. Cl. ..... 271/274; 271/314; 381/142
(58) Field of Search ..... 271/314, 109, 271/272, 274, 275, 264; 400/354, 352; 384/192

(56) References Cited

U.S. PATENT DOCUMENTS

| | | | | |
|---|---|---|---|---|
| 5,332,321 A | * | 7/1994 | Beauchamp et al. | 400/354 |
| 5,348,283 A | | 9/1994 | Yanagi et al. | 271/127 |
| 5,366,305 A | | 11/1994 | Christianson | 400/354 |
| 5,672,019 A | | 9/1997 | Hiramatsu et al. | 400/624 |
| 5,793,399 A | | 8/1998 | Kawakami et al. | 347/104 |
| 5,867,196 A | | 2/1999 | Kiyohara et al. | 347/104 |
| 5,886,729 A | | 3/1999 | Hiramatsu et al. | 347/264 |
| 5,899,451 A | | 5/1999 | Kiyohara et al. | 271/167 |
| 5,992,993 A | | 11/1999 | Kiyohara et al. | 347/104 |
| 6,045,220 A | | 4/2000 | Kiyohara et al. | 347/104 |
| 6,168,270 B1 | | 1/2001 | Saikawa et al. | 347/104 |
| 6,390,700 B1 | * | 5/2002 | Foster et al. | 400/624 |
| 6,524,021 B2 | * | 2/2003 | Johnson et al. | 400/354 |

FOREIGN PATENT DOCUMENTS

| | | |
|---|---|---|
| JP | 7-19246 | 1/1995 |

* cited by examiner

*Primary Examiner*—Donald P. Walsh
*Assistant Examiner*—Kaitlin Joerger
(74) *Attorney, Agent, or Firm*—Fitzpatrick, Cella, Harper & Scinto

(57) ABSTRACT

An image recording apparatus comprises a roller, and a bearing fixed to the apparatus main body to rotatably support the roller through the shaft portion of the roller. The bearing is provided with at least two contact portions to be in contact with the shaft portion of the roller, and the shaft portion of the roller is biased to each of the contact portions. With the structure thus arranged, it becomes possible for this apparatus to enhance the sheet conveyance precision or to make the roller smaller at lower costs.

5 Claims, 10 Drawing Sheets

IMAGE RECORDING APPARATUS

BACKGROUND OF THE INVENTION

1. Field of the Invention

The present invention relates to an image recording apparatus. More specifically, the invention relates to the structure that supports the shaft portion of a conveying roller.

2. Related Background Art

As one example of the conventional image recording apparatus, there is the so-called serial recording apparatus that performs recording on the surface of a sheet by moving the carriage, which mounts a recording head thereon, in the direction orthogonal to the sheet conveying direction (hereinafter referred to as the sheet widthwise direction). Then, the structure is arranged to provide the serial recording apparatus of the kind with a sheet-conveying device that conveys the sheet under the carriage, and record images on the sheet, while repeating alternately the sheet conveyance by the sheet conveying device and the recording by use of the carriage.

Now, in recent years, it has been increasingly demanded for the reasons that images should be formed in higher image quality that the pixel pitches of a recording head is made smaller, while enhancing the conveyance precision of a sheet with respect to the sheet-conveying device.

Here, for the conventional sheet-conveying device, it has been practiced to provide a conveying roller as sheet conveying means, while supporting the conveying roller with the cylindrical bearing portion having a diameter slightly larger than the diameter of the shaft portion arranged for the apparatus main body.

Then, with the structure thus arranged, the shaft portion of the conveying roller and the bearing are in contact only on one contact line. For example, when the conveying roller is at rest, the contact line of the shaft portion of the conveying roller and the bearing is positioned on a designated position by means of the pressurized direction of the pinch roller that is arranged to press the sheet to the conveying roller, the pressure exerted by the conveying roller and the weight of its own, among some others.

On the other hand, when the conveying roller rotates or it is in transition from the stationary condition to the rotation or the like, the rotational acceleration, frictional coefficient, and various other conditions are added, and although the same when it is at rest, the position of the contact line is caused to change minutely due to the delicate configuration of the shaft portion of the conveying roller or the bearing, such as the degree of roundness thereof. Then, such change of the positions of the contact line means the delicate changes of the position of the conveying roller, and such delicate positional changes of the conveying roller presents a problem in materializing the conveyance precision that should be made more precise.

Also, if the friction load between the shaft portion of the conveying roller and the bearing is not stable, the variation of stationary position tends to occur when transition is made from the rotation to the stationary condition. Further, if the friction load is larger, the rotational load of the conveying roller increases to hinder the intended high-speed operation.

Furthermore, there is a need for the provision of an installation space for the bearing on the entire circumference of the conveying roller in the vicinity of the shaft portion of the conveying roller. Consequently, a problem is encountered that the position of the bearing or the like should be restricted.

For example, if the conveying roller the strength of which is weak should be supported only at both ends thereof, the conveying roller warps in the central portion to make it impossible to maintain the distance between the carriage and the sheet constantly or to invite the deterioration of conveyance precision of the conveying roller, hence producing unfavorable effects on the precision of the recorded images. Therefore, it should be considered to arrange a bearing on the central portion of the conveying roller in order to prevent the warping of the central portion of such bearing.

However, if a bearing is arranged on the central portion of such conveying rollers there occurs a need, as described earlier, for the provision of the installation space on the entire circumference of the conveying roller for the bearing in the vicinity of the shaft portion. Then, a problem is encountered that the conveyance of the sheet is impeded by the presence of such bearing after all.

On the other hand, it is attempted to enhance the precision of components of the conveying roller as another method to comply with the request for the enhancement of the conveyance precision of the sheet. Here, it is known that if the eccentric precision, which indicates the fluctuation of rotational center of the conveying roller, is improved in particular, the conveyance precision of the sheet is effectively enhanced.

Therefore, there has been proposed a conveying roller such as the one provided with a thin film coating or the like on the circumference of a metallic shaft that forms the shaft portion in order to generate conveying force, or the so-called metallic roller that generates the conveying force with the irregularities given to the surface of the metallic shaft, among some others. Since each roller of these kinds is formed to provide substantially the same diameters for the shaft portion serving as the rotational center and the conveying portion that has the conveying force, the fluctuation of the rotational center is made considerably smaller with respect to the conveying portion.

Nevertheless, even for such a metallic roller as this, the degree of straightness of the conveying roller or the like exerts a great influence on the conveying portion away from the bearing, for example, there is a problem encountered that the fluctuation of rotational center becomes great, although there is almost no fluctuation of the rotational center on the conveying portion near the bearing.

On the other hand, it is also required to increase the pressurized contact of the pinch roller in order to press the sheet to be in contact with the conveying roller for the enhancement of the conveyance precision of the sheet. Along with this, there is a demand in making the apparatus smaller at lower costs, which necessitates the provision of the structure of a conveying roller made smaller yet allowing no deformation even with a designated pressure.

SUMMARY OF THE INVENTION

It is an object of the present invention to provide an image forming apparatus for which the enhancement of sheet conveyance precision is possible or the conveying roller can be made smaller, and the reduction of costs is possible as well.

It is another object of the invention to provide an image forming apparatus provided with a conveying roller for conveying a sheet, and a bearing portion fixed to the apparatus main body for rotatably supporting the conveying roller through the shaft portion of the conveying roller, in which the bearing portion has at least two contact portions to be in contact with the shaft portion of the conveying roller, and the shaft portion of the conveying roller is biased to the contact portions.

DETAILED DESCRIPTION OF THE PREFERRED EMBODIMENTS

Hereinafter, with reference to the accompanying drawings, the detailed description will be made of the embodiments in accordance with the present invention.

At first, a first embodiment of the invention will be described.

Figure 1:
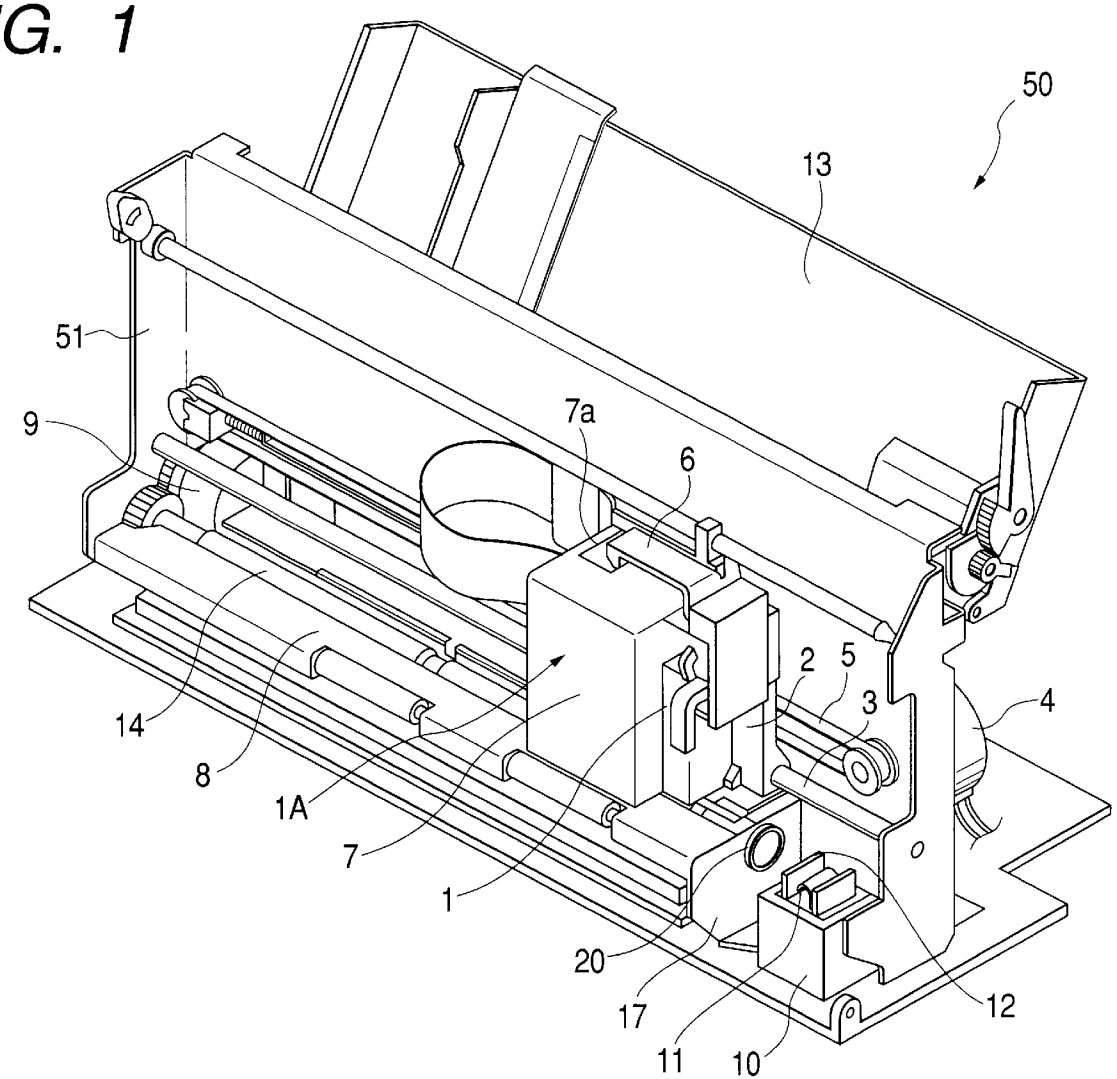
FIG. 1 is a perspective view that shows the one example of the recording apparatus, which is a first embodiment of the image forming apparatus in accordance with a first embodiment of the present invention.

FIG. 1 is a perspective view that shows one example of the image forming apparatus in accordance with the first embodiment of the invention.

In FIG. 1, a reference numeral 50 designates the recording apparatus that records by use of ink jet method. The recording apparatus 50 is provided with an ink cartridge 1A serving as the image forming member comprising a recording head 1 and in ink tank 7 that supplies ink to the recording head 1.

In this respect, the recording head 1 is provided with means for generating thermal energy as energy to be utilized for discharging ink in particular, among those using ink jet recording method, so as to attain recording in high density and high precision using the method in which the status changes of ink is generated by the application of such thermal energy.

Then, as shown in FIG. 1, the recording head 1 is mounted on the carriage 2 in a posture so that ink is discharged downward. The carriage 2 moves along the guide shaft 3 to discharge ink liquid droplets to a sheet (not shown) like a recording sheet for the formation of images thereon.

In this respect, the movement of the carriage 2 in the sheet widthwise direction (reciprocal movement) is conducted by way of a timing belt 5 driven by a carriage motor 4 to rotate. Also, for the carriage 2, a hooking nail 6 is provided, and when this hooking nail 6 engages with the hooking hole 7*a* of the ink tank 7, the ink tank 7 is fixed to the carriage 2.

Also, when the recording head 1 completes recording for one-scanning portion, the recording operation is suspended, and the sheet positioned on the platen 8 is conveyed by a designated amount by use of the conveying roller 14 driven by a feed motor 9. Then, the carriage 2 moves again along the guide shaft 3 to form images for the next One-scanning portion. In this respect, the driving force of the feed motor 9 for conveying the sheet is also transmitted to an automatic sheet feeder (ASF) 13 besides being transmitted to the conveying roller 14.

On the other hand, a recovery device 10 is arranged on one side portion (right side) of the apparatus main body 51 for the execution of recovery operation in order to maintain the ink discharge of the recording head 1 in good condition. For the recovery device 10, there are provided a cap 11 for covering the ink discharge ports of the recording head 1, a wiper 12 for wiping the ink discharge surface of the recording head 1 (the surface where many numbers of ink discharge ports are arranged), and a suction pump (not shown) for sucking ink form the ink discharge ports of the recording head 1.

Figure 2:
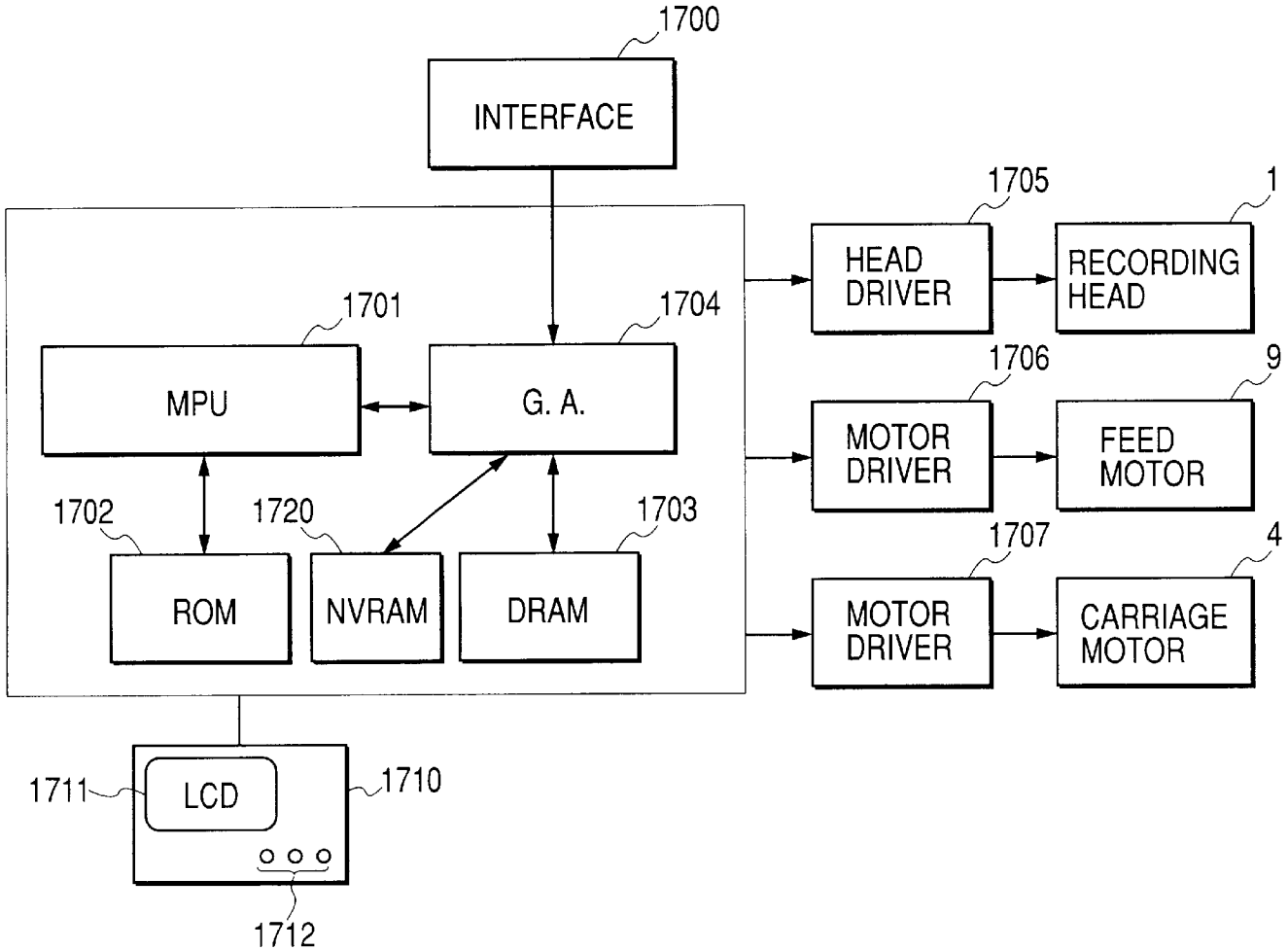
FIG. 2 is a block diagram that shows the control of the recording apparatus represented in FIG. 1.

FIG. 2 is a block diagram that shows the control of a recording apparatus of the kind 50. In FIG. 2, a reference numeral 1700 designates an interface for the input of recording signal; 1701, an MPU; 1702, a ROM that stores the control program executed by the MPU 1701; and 1703, a DRAM that retains various data. Also, a reference numeral 1704 designates the gate array (GA) that controls the supply of recording data to the recording head 1. The gate array 1704 also controls the data transfer between the interface 1700, the MPU 1701, and the DRAM 1703. A reference numeral 1705 designates a head driver for driving the recording head 1, and 1706 and 1707 are head drivers to drive a feed motor 9 and carriage motor 4, respectively.

Then, when recording signal is inputted into the interface 1700, the motor drivers 1706 and 1707 are driven, while the recording signal is converted in converted into the recording data for use of a printer between the gate array 1704 and the MPU 1701 and transmitted to the head driver 1705. Thus, the recording head 1 is driven in accordance with the recording data for the execution of recording.

In this respect, a reference numeral 1710 designates the display portion provided with the LCD 1711 that displays various messages regarding the status of the recording operation or the recording apparatus, and the LED lamp 1712 having various colors to indicated the status of the recording operation or the recording apparatus.

Figure 3:
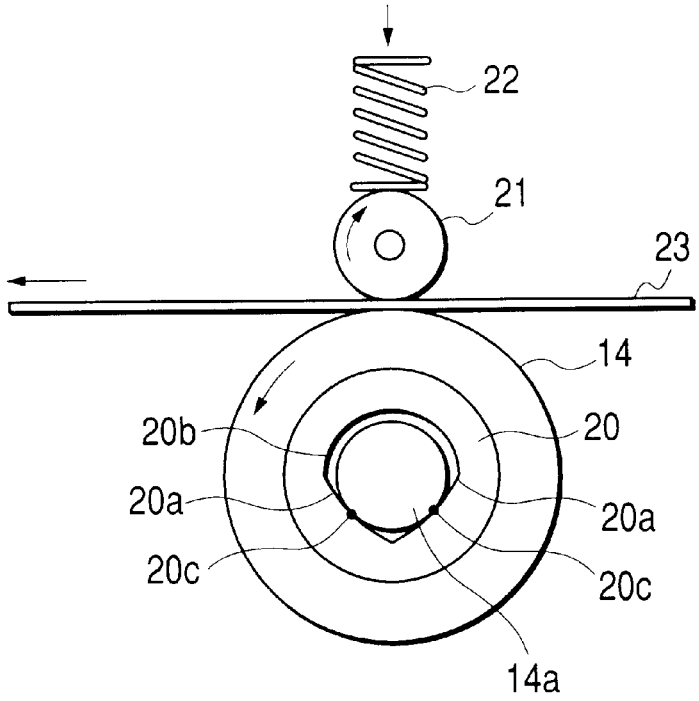
FIG. 3 is a side view that shows the structure of the sheet conveying device provided for the recording apparatus represented in FIG. 1.

Now, FIG. 3 is a side view that shows the structure of the sheet-conveying device. In FIG. 3, a reference numeral 14*a* designates the conveying roller shaft, which is arranged at both ends of the conveying roller 14, and 20, a bearing that rotatably supports the conveying roller 14 through the conveying roller shaft portion 14*a*. In this respect, the bearing 20 is fixed to the sheet-conveying device main body, thus being fixed to the recording apparatus main body.

Also, in FIG. 3, a reference numeral 21 designates the pinch roller that is arranged above the conveying roller 14. The pinch roller 21 presses the sheet 23 to the conveying roller 14 by the pressurized contact force of a pinch roller spring 22. The sheet 23 thus pressed by the pinch roller 21 is conveyed in the direction indicated by an arrow in FIG. 3 along the rotation of the conveying roller 14.

On the other hand, for the inner circumference of the bearing 20, there are formed the arc portion 20*a* of the bearing that forms at least two contact portions (two for the present embodiment), which are in contact with the shaft portion 14*a* of the conveying roller within the plate that intersects with the axial direction, and the other arc portion 20*b*. Here, for the present embodiment, this bearing arc portion 20*a* constitutes the curved recessed portion formed by arc sufficiently larger than the outer circumference of the shaft portion 14*a* of the conveying roller. The other arc portion 20*b* is formed to provide a clearance to the outer circumference of the shaft portion 14*a* of the conveying roller.

Here, as described already, the conveying roller 14 is pressed downward by means of the pinch roller 21 so that the shaft portion 14*a* of the conveying roller is pressed in the direction toward the two bearing arc portions 20*a*. Being pressed by the pinch roller 21 in this manner, the conveying roller 14*a* is stabilized to be in tangentially in contact with the two bearing arc portions 20*a* (in the axial direction). Here, in FIG. 3, a reference mark 20*c* designates the contact line.

Then, with the shaft portion 14*a* of the conveying roller tangentially in contact with at least two arc portions 20*a* or the bearing, the conveying roller 14 is always positioned at the same position of the bearing 20. In this way, the position of the conveying roller 14 is stabilized without changes. As a result, it becomes possible to prevent the degrading the sheet conveyance precision that may be brought about by minute movement of the conveying roller 14.

Next, in conjunction with FIG. 4, the description will be made of a second embodiment of the mode embodying the present invention. Here, in FIG. 4, the same reference marks as those appearing in FIG. 3 designate the same parts or corresponding parts.

Figure 4:
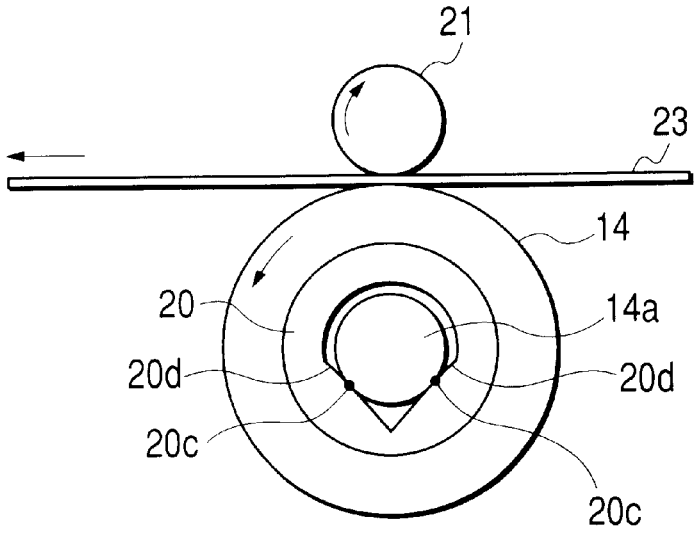
FIG. 4 is a view that illustrates a second embodiment of the first embodiment.

In FIG. 4, a reference numeral 20*d* designates the straight line portion of the bearing arranged in the inner circumferential portion of the bearing 20, which forms at least two contact portions that contact the shaft portion 14*a* of the conveying roller. With the provision of the straight-line portion 20*d* of the bearing that forms a flat plane instead of the arc portion 20*b* of the bearing, the shaft portion 14*a* of the conveying roller is stabilized to be continuously in contact with the bearing 20 (the straight-line portion 20*d* of the bearing). In this way, the position of the conveying roller 14 does not change. As a result, it becomes possible to prevent the degradation of the sheet conveyance precision that may be brought about by the minute movement of the conveying roller 14.

Next, in conjunction with FIG. 5, a third embodiment will be described in accordance with the present invention. Here, in FIG. 5, the same reference marks as those appearing in FIG. 3 designate the same parts or corresponding parts.

Figure 5:
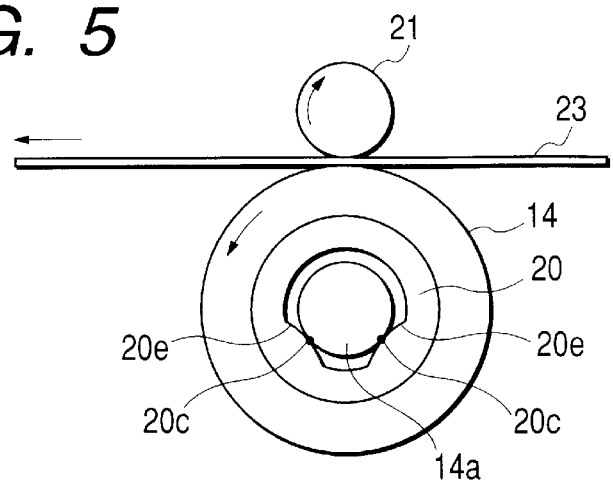
FIG. 5 is a view that illustrates a third embodiment of the first embodiment.

In FIG. 5, a reference numeral 20*e* designates the arc portion of the bearing arranged in the inner circumferential portion of the bearing 20, which forms at least two contact portions that contact the shaft portion 14*a* of the conveying roller. The arc, the center of which exists in the outward direction beyond the outer circumference of the bearing, forms the arc portion 20*e* of the bearing.

Then, with the provision of the arc portion 20*e* of the bearing that forms a curved convex surface the center of which exists in the outward direction beyond the outer circumference of the bearing instead of the arc portion 20*a* of the bearing, the shaft portion 14*a* of the conveying roller is stabilized to be continuously in contact with the bearing 20 (the arc portion 20*e* of the bearing). In this way, the position of the conveying roller 14 does not change. As a result, it becomes possible to prevent the degradation of the sheet conveyance precision that may be brought about by the minute movement of the conveying roller 14.

Next, in conjunction with FIG. 6, the description will be made of a fourth embodiment of the mode embodying the present invention. Here, in FIG. 6, the same reference marks as those appearing in FIG. 4 designate the same parts or corresponding parts.

Figure 6:
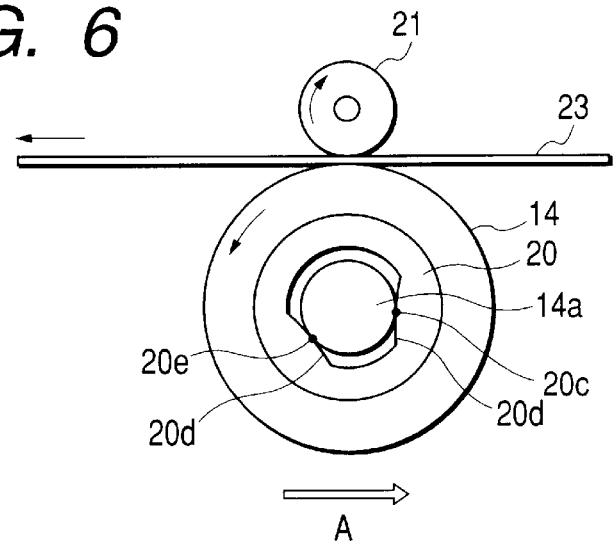
FIG. 6 is a view that illustrates a fourth embodiment of the first embodiment.

For the present embodiment, as shown in FIG. 6, one of the straight line portions 20*d* of the bearing is arranged in the position that is in contact with the rear side of the shaft portion 14*a* of the conveying roller in the sheet conveying direction or in the vicinity thereof. Then, with the installation of one of the straight portions 20*d* of the bearing in such position, the conveying roller 14 receives reverse reaction in the sheet conveying direction when the sheet is conveyed, hence making it possible to stop the force that tends to shift in the direction indicated by an arrow A in FIG. 6. As a result, the position of the conveying roller 14 is stabilized more to eliminate any changes thereof.

Here, for the present embodiment, the description has been made of the case where one of the straight portions 20*d* of the bearing is installed in the position that is in contact with the rear side of the shaft portion 14*a* of the conveying roller in the sheet conveying direction or in the vicinity thereof. However, it may be possible to install one of the arc portions 20*a* and 20*e* of the bearing in the position that is in contact with the rear side of the shaft portion 14*a* of the conveying roller in the sheet conveying direction or in the vicinity thereof.

Next, the description will be made of a second embodiment in accordance with the present invention.

Figure 7:
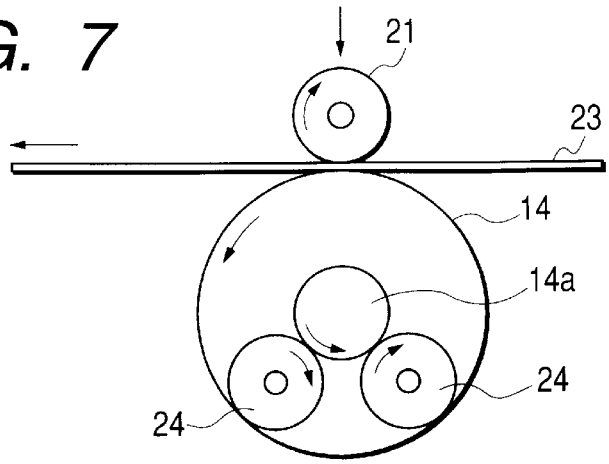
FIG. 7 is a view that illustrates a second embodiment in accordance with the present invention.

FIG. 7 is a view that illustrates the present embodiment. In FIG. 7, the same reference marks appearing in FIG. 3 designate the same parts or the corresponding parts.

In FIG. 7, a reference numeral 24 designates the rotational bearing that constitutes plural rotational members (two) to support rotatably the shaft portion 14*a* of the conveying roller, which is installed in place of the aforesaid bearing 20. With the rotational bearing 24, the conveying roller 14 is rotatably supported through the shaft portion 14*a* of the conveying roller, thus rotating in the direction indicated by an arrow in FIG. 7. Along with this, the sheet 23 is conveyed in the direction indicated by an arrow.

Now, when the shaft portion 14*a* of the conveying roller rotates in that way, the rotational bearing 24 also rotates in the directions indicated by arrows in FIG. 7. Then, with such rotation of the rotational bearing 24, there is no frictional load or instable load given to the shaft portion 14*a* of the conveying roller. As a result, it becomes possible for the conveying roller 14 to prevent fluctuation of the stationary position thereof when it shifts from rotation to stationary condition, while attempting the higher speed of the sheet conveyance.

Next, the description will be made of a third embodiment in accordance with the present invention.

Figure 8:
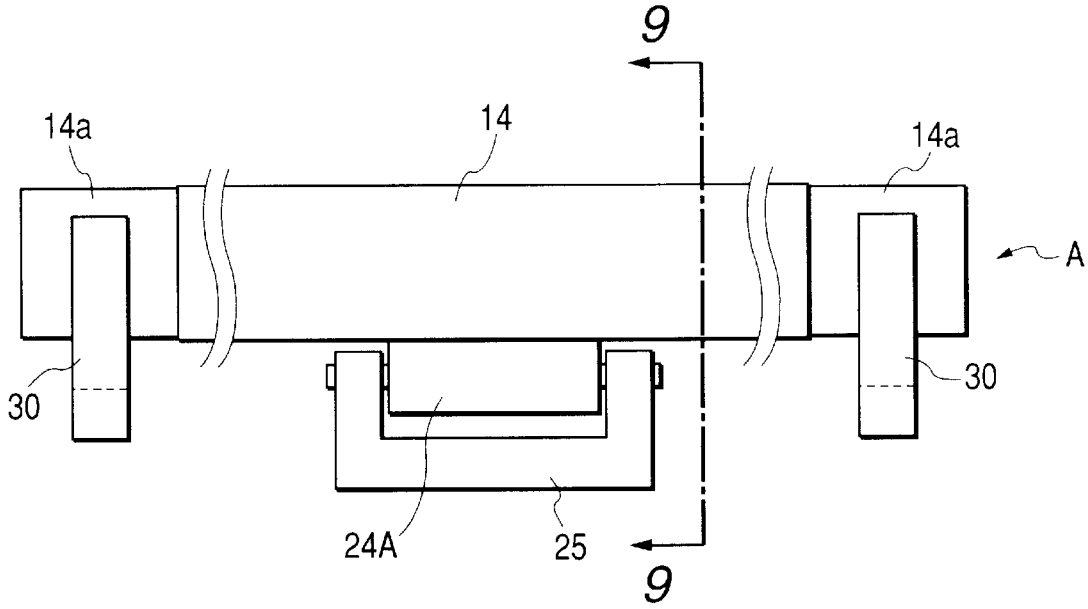
FIG. 8 is a view that illustrates a third embodiment in accordance with the present invention.

FIG. 8 is a view that illustrates the present embodiment. In FIG. 8, the same reference marks appearing in FIG. 3 designate the same parts or the corresponding parts.

In FIG. 8, a reference numeral 24A designates the supporting member that supports the conveying roller 14 from below in the longitudinal direction thereof. The supporting member 24A is made rotational along the rotation of the conveying roller 14.

Then, with the central portion of the conveying roller 14 being supported by the supporting member 24A in this way, it becomes possible to position the conveying roller 14 in the direction from the top to the bottom. Thus, for example, even when the strength of the conveying roller 14 is weak, it is possible to prevent the central portion of such conveying roller 14 from being warped, and to maintain the distance between the carriage 2 and the sheet 23 constantly, while preventing the degradation of the conveyance precision of the conveying roller 14. As a result, images can be recorded in high precision.

Figure 9:
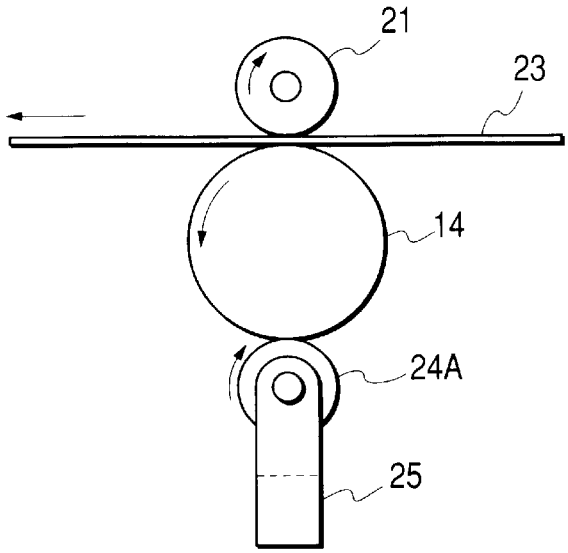
FIG. 9 is a cross-sectional view taken in the direction indicated by line B—B in FIG. 8.

Here, in FIG. 8, a reference numeral 25 designates a holder that rotatably supports the supporting member 24A. With this holder 25, it is arranged to position the supporting member 24A in the direction from the top to the bottom, which receives force exerted by the conveying roller 14 from above as shown in FIG. 9.

Figure 10:
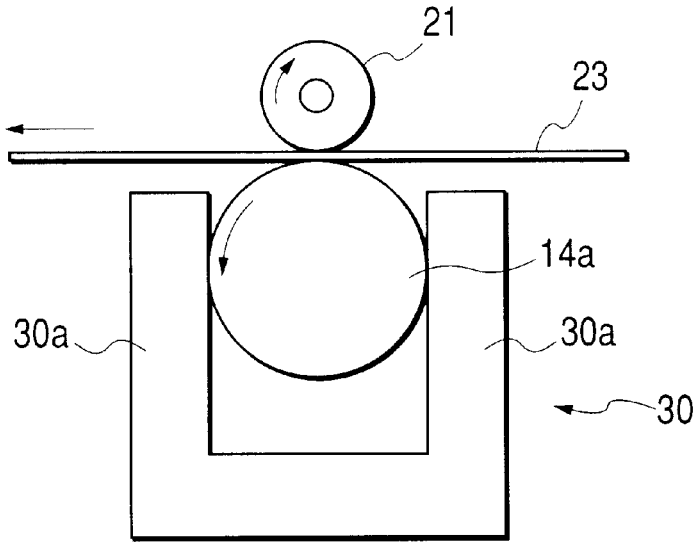
FIG. 10 is a cross-sectional view taken in the direction A in FIG. 8.

On the other hand, a reference numeral 30 designates each of the fixed bearings to support rotatably both end portions of the conveying roller 14 in the longitudinal direction. Here, as shown in FIG. 10, the bearing 30 is provided with a regulating portion 30*a*, each of which is installed to stand facing each other for regulating the movement of the shaft portion 14*a* of the conveying roller. With the bearing 30 (regulating portion 30*a*), the conveying roller 14 is positioned in the sheet conveying direction.

Thus, the conveying roller 14 is positioned by the supportion member 24A in the direction from the top to the bottom, while positioning the conveying roller 14 by each of the bearings 30 in the sheet conveying direction. In this way, the position of the conveying roller 14 is stabilized to eliminate the changes thereof. As a result, it becomes possible to eliminate the degradation of the sheet conveyance precision that may be caused by the minute movement of the conveying roller 14.

Next, the description will be made of a fourth embodiment in accordance with the present invention.

Figure 11:
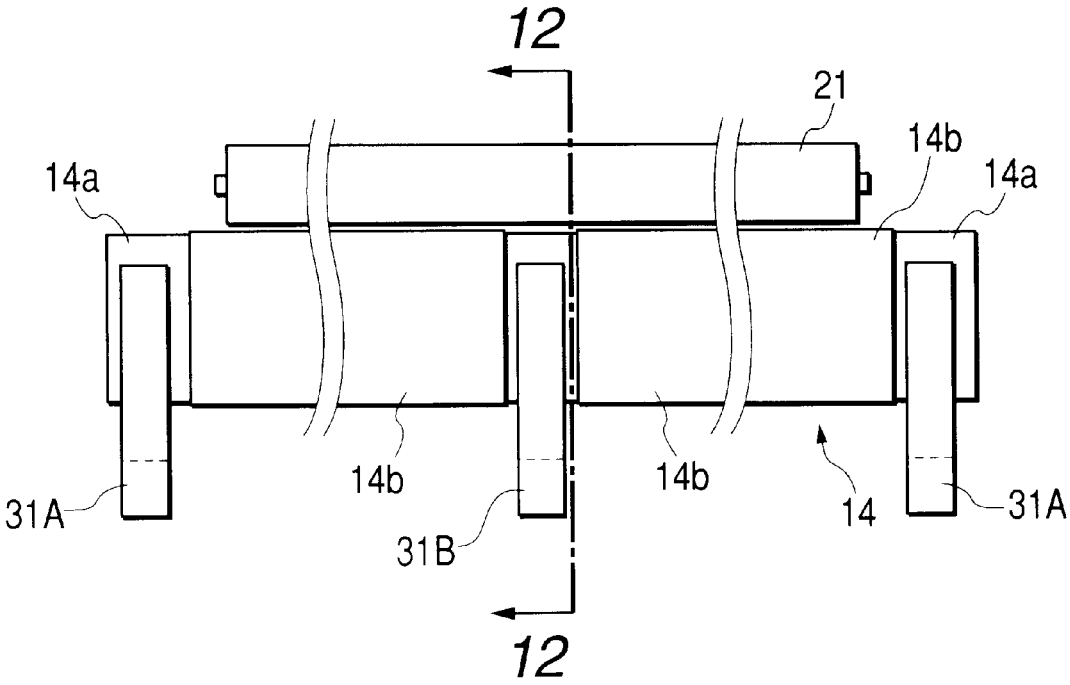
FIG. 11 is a view that illustrates a first embodiment in accordance with a fourth embodiment of the present invention.

FIG. 11 is a view that illustrates the present embodiment. In FIG. 11, the same reference marks appearing in FIG. 8 designate the same parts or the corresponding parts.

In FIG. 11, a reference numeral 14*b* designates a plurality of the sheet conveying members of the conveying roller 14 that abut against a sheet; 31A, each of the bearings that support the conveying roller shaft portion 14*a* of the conveying roller 14. Also, a reference numeral 31B designates the supporting member that supports the conveying roller shaft portion 14*a*, which is positioned between the conveying members 14*b* of the conveying roller 14, in the central portion in the longitudinal direction, and with the bearing 31B that supports the conveying roller 14, it becomes possible to prevent the central portion of the conveying roller 14 from being warped even if the strength of the conveying roller 14 is weak.

Figure 12:
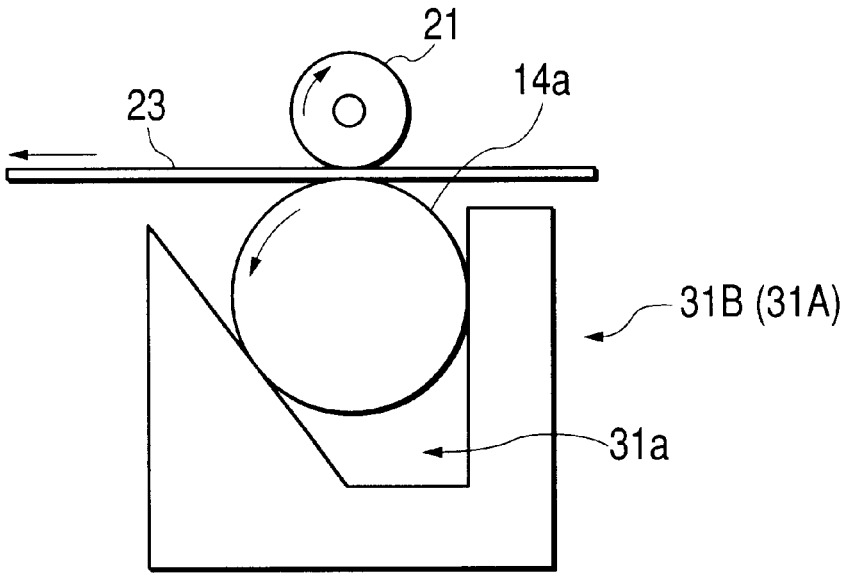
FIG. 12 is a cross-sectional view taken in the direction indicated by line B—B in FIG. 11.

Here, in accordance with the present embodiment, there is provided each of the V-letter grooves 31*a* having open upper part as shown in FIG. 12, for example, for the three bearings 31A, 31A, and 31B, respectively. With the V-letter grooves 31*a* thus formed, it becomes unnecessary to secure the space to install the bearing 31B all around the conveying roller 14 even when the bearing 31B is arranged for the central portion of the conveying roller 14, for example. In this way, it becomes possible to freely select the position for installing the bearing. Also, the bearings 31A and 31B are provided with at least two contact portions to be in contact with the conveying roller shaft portion 14*a* to make it possible to stabilize the position of the conveying roller 14.

Thus, without hindering the conveyance of the sheet 23, the distance between the carriage 2 and the sheet 23 can be maintained constantly, while preventing the degradation of the conveyance precision of the conveying roller 14, to enable printing in high precision. Further, with the central portion of the conveying roller 14 being supported in this manner, there is no need for making the diameters of the conveying roller 14 and the conveying roller shaft portion 14*a* larger when a designated pressure is exerted by means of the pinch roller 21, yet preventing the warping thereof. Therefore, it becomes possible to make the conveying roller 14 smaller at lower costs.

Figure 13:
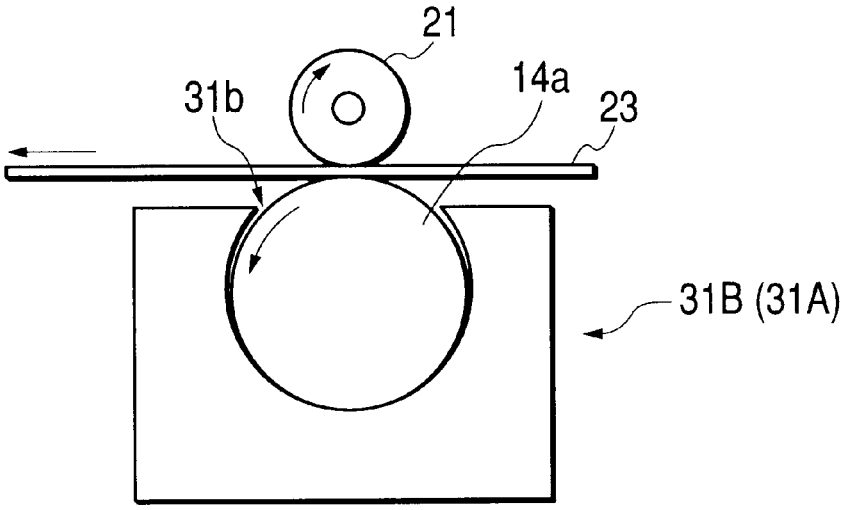
FIG. 13 is a view that illustrates a second embodiment in accordance with the fourth embodiment of the present invention.

In this respect, as the shape of the bearings 31A and 31B, it may be possible to provide the one provided with an insertion hole 31*b* having a diameter slightly larger than the outer diameter of the conveying roller shaft portion 14*a* with open upper portion as shown in FIG. 13, for example, besides the one shown in FIG. 12, if only there is no need for the provision of a space for installing the bearing 31B all around the conveying roller 14.

Next, the description will be made of a fifth embodiment.

Figure 14:
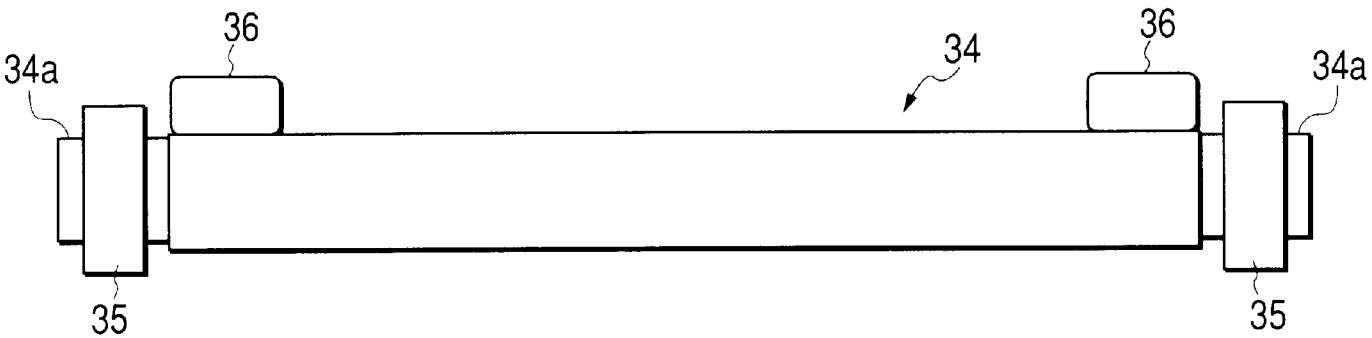
FIG. 14 is a view that illustrates a fifth embodiment in accordance with the present invention.

FIG. 14 shows the present embodiment. In FIG. 14, a reference numeral 34 designates a conveying roller. Then, the conveying roller 34 is rotatably supported by each of the bearings 35 arranged on both ends through the conveying roller shaft portion 34*a*.

Also, a reference numeral 36 designates a pinch roller installed above the conveying roller 34. The pinch roller 36 presses a sheet (not shown) to be in contact with the conveying roller 34 by the pressurized contact force exerted by a pinch roller spring (not shown). Then, the arrangement is made so that the sheet, which is pressed to be in contact with the conveying roller 34 by the pinch roller 36, is conveyed along the rotation of the conveying roller 34.

Now, each of the pinch rollers 36 is installed on both end portions of the conveying roller 34, respectively, that is, only in the vicinity of each bearing 35. Therefore, there is almost no sheet conveying force on the central portion of the conveying roller 34 in the longitudinal direction. The structure is arranged to generate the sheet conveying force of the conveying roller 34 only in the vicinity of each bearing 35, that is, only on the left and right end portions.

With the structure thus arranged, the conveying roller 34 makes its rotational motion centering on the center of the conveying roller shaft portion 34*a* supported by the bearing 35. As a result, even when the amount of displacement of the conveying roller 34 becomes greater on the central portion thereof in the longitudinal direction, the amount of displacement is made extremely small in the vicinity of each bearing, thus making it possible to minimize the unfavorable effect that may be produced on the sheet conveyance precision due to the eccentric precision.

Next, the description will be made of a sixth embodiment in accordance with the present invention.

Figure 15:
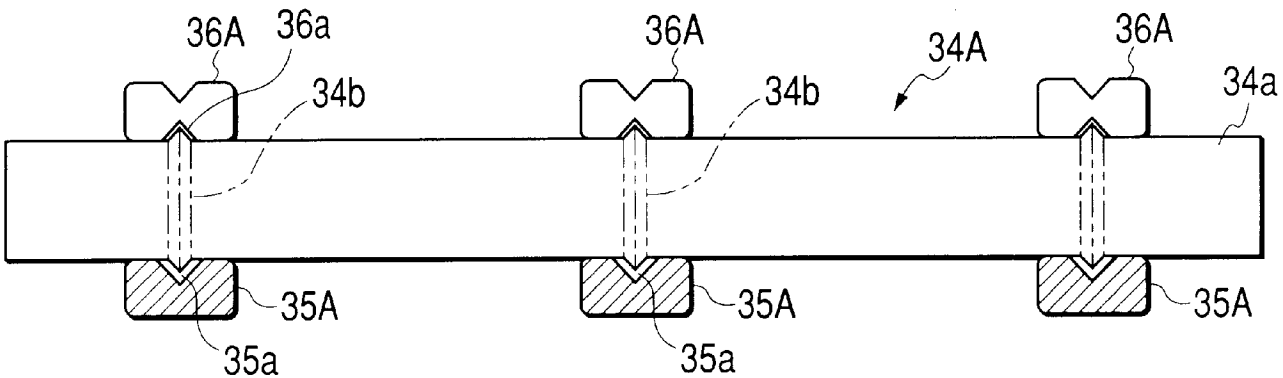
FIG. 15 is a view that illustrates a sixth embodiment in accordance with the present invention.

FIG. 15 is a view that shows the present embodiment. In FIG. 15, a reference numeral 34A designates a metallic roller, which is one example of the conveying roller that generates conveying force by the provision of a thin film coating or irregularities (not shown) on the circumference of a metallic shaft that forms the conveying roller shaft portion 34*a*. For this metallic roller 34A (conveying roller shaft portion 34*a*), there are arranged extrusions 34*b*, each one of them being provided for the central portion and the left and right portions, three locations in total.

A reference numeral 35A designated a bearing that supports the metallic roller 34A rotatably. On the position of the bearing 35A, which faces the extrusion 34*b* of the metallic roller 34A, a recessed portion 35*a* is formed in a shaft that does not interfere with the extrusion 34*b* of the metallic roller 34A. Also, a reference numeral 36A designates a pinch roller. On the position of the pinch roller 36A, which faces the extrusion 34*b* of the metallic roller 34A, a recessed portion 36*a* is formed in a shaft that does not interfere with the extrusion 34*b* of the metallic roller 34A.

Then, the bearing 35A and pinch roller 36A thus structures are installed on the position that faces the extrusion 34*b* of the metallic roller 34A to minimize the amount of displacement in the vicinity of the bearing 35A. As a result, the unfavorable effect that may be produced on the sheet conveyance precision is minimized. Here, in the structure thus formed, the conveying portion that abuts against a sheet for the conveyance thereof is between the two extrusions.

Next, the description will be made of a seventh embodiment.

Figure 16:
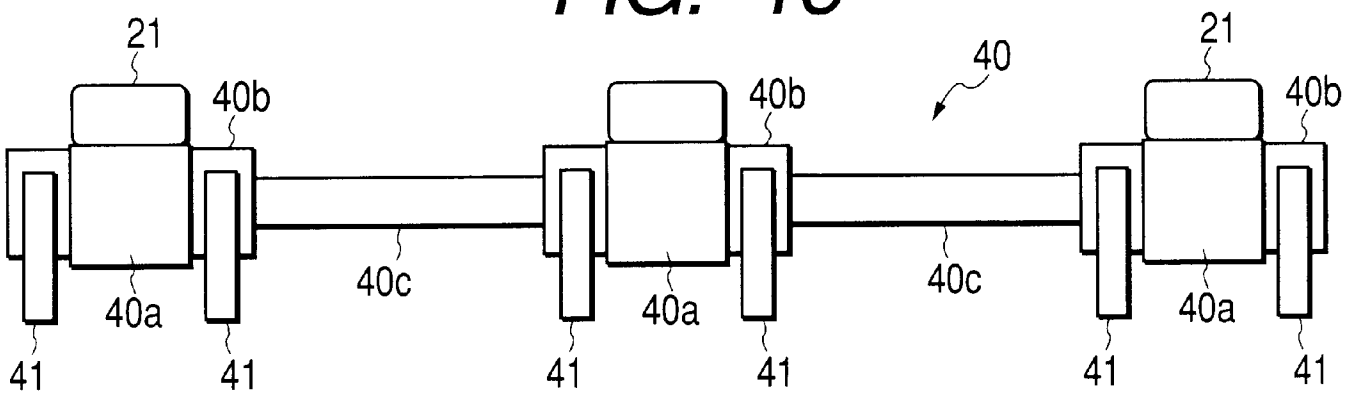
FIG. 16 is a view that illustrates a first embodiment in accordance with a seventh embodiment of the present invention.

FIG. 16 is a view that illustrates a first embodiment of this mode embodying the present invention.

In FIG. 16, a reference numeral 40 designates a conveying roller. The conveying roller 40 is provided with a plurality of conveying portions 40*a*, each of them being arranged on the central portion and both end portions of the conveying roller in the longitudinal direction, respectively, that is, three locations in total. Then, on the upper face of the conveying portion 40*a*, a pinch roller 21 is in contact under pressure. Also, on both sides of the conveying portion 40*a*, there are arranged shaft portions 40*b* having substantially the same diameter, respectively. The conveying roller shaft portion 40*b* is supported rotatably by each of the bearings 41.

On the other hand, the connecting portion 40*c*, which is thinner than the diameter of the shaft portion 40*b* that serves as the metallic portion, connects each of the conveying portions 40*a*, and the rotational power is transmitted by use of the connecting portion 40*c*. Here, in accordance with the present embodiment, the diameter of the connecting portion 40*c* is made smaller to make it possible to warp freely. Then, it is arranged to absorb errors with the warping that may occur when positioning by means of the bearings 41 installed on the three locations.

In this way, the conveying roller 40 is supported by the bearing 41 in the vicinity of the conveying portion 40*a* to attempt the enhancement of the sheet conveyance precision, while implementing the absorption of errors in positioning by use of each of the bearings 41. Further, supporting the central portion of the conveying roller 40 in such a manner, it becomes possible to prevent warping without making the diameter of the conveying roller 40 (connecting portion 40*c*) when a designated pressure is given by use of the pinch roller 21. Thus, the conveying roller 40 can be made smaller at lower costs.

In this respect, the metallic connecting portion 40*c* formed to be in a diameter smaller than that of the conveying roller shaft portion 40*b* may be formed using a plastic molding material or the like, for example, thus providing elasticity to make it easier to warp. Here, such metallic part and plastic part may be formed integrally by the application of molding technology, such as integrated formation.

Next, in conjunction with FIG. 17, the description will be made of a second embodiment of this mode embodying the present invention. Here, in FIG. 17, the same reference marks as those appearing in FIG. 16 designate the same parts or corresponding parts.

Figure 17:
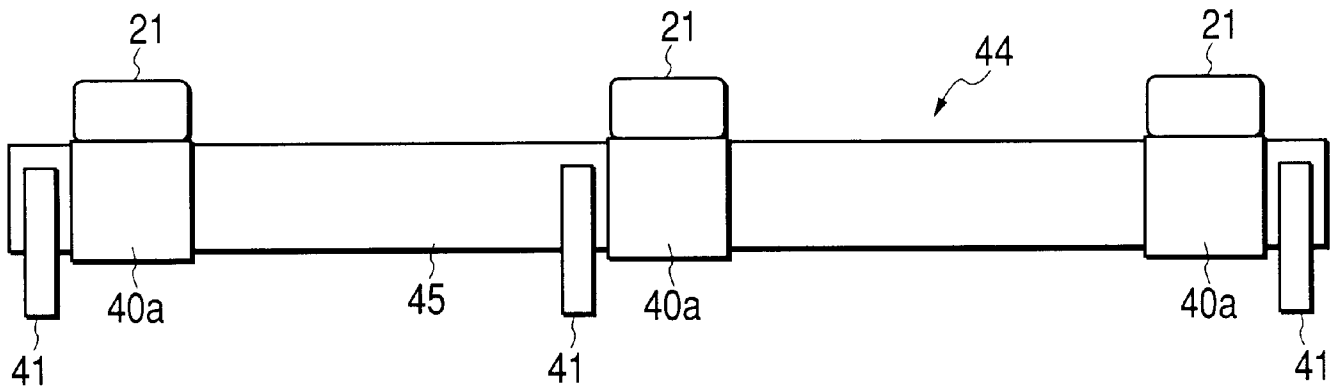
FIG. 17 is a view that illustrates a second embodiment in accordance with the seventh embodiment of the present invention.

FIG. 17, a reference numeral 44 designates a conveying roller. The conveying roller 44 is provided with a plurality of conveying portions 40*a*, each formed by winding the outer circumference thereof a metallic plate having an irregularly processed surface, and arranged for three locations in the longitudinal direction, the central portion and both ends, of one piece conveying roller 45 formed by plastic molding material.

Here, the conveying roller 44 is rotatably supported by the bearing 41, which is installed either on the left or the right side near each of the conveying portions 40*a*. Then, with the structure thus arranged, a plurality of the conveying portions 40*a* is supported by each of the bearing 41 installed nearby. In this way, it becomes possible to attempt the enhancement of the sheet conveyance precision, as well as to implement the absorption of errors in positioning at each of the bearings 41.

Figure 18:
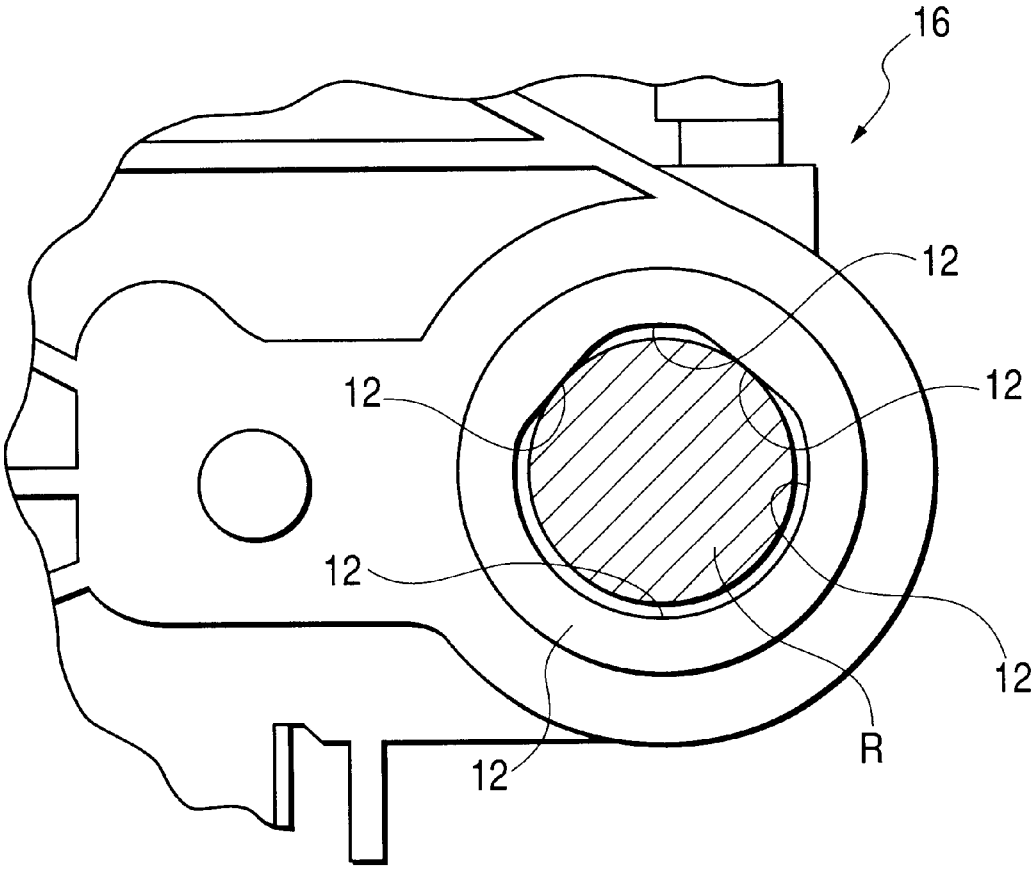
FIG. 18 is a view that shows the structure of the conventional bearing related to the present invention.

Now, as the bearing structure of a recording apparatus related to each of the modes embodying the present invention, and the embodiments thereof as well, there is, for example, the one disclosed in the specification of Japanese Paten Laid-Open Application No. 7-19246 (FIG. 18).

The disclosed structure is such that a bearing 12 having a pear-like through hole 12*a* is provided for a carriage 16 to be mounted on a recording head, and that the rail R that guides the carriage serially is formed to be slidably supported with two linear contacts by the weight of the carriage 12 own. Then, for the bearing system, to which this structure relates, the bearing 12 of the carriage that moves is the member that stops irregular fluctuations at the time of driving. Also, the rail R is the member, which is fixed. In other words, the member 12, which should stop abnormal movement (such as vibration or fluctuation), as an important functional element of the apparatus, is always in contact with the rail R substantially on the same location, and moves. As a result, the carriage bearing 12 tends to be easily affected by frictional wearing or the like.

In contrast, for the present invention, the roller shaft 14*a* is the member that should stop irregular fluctuations at the time of driving. On the other hand, the bearing 20 is the fixed member. In other words, the rotating roller shaft 14*a* is the member that should stop abnormal movement as the important functional element of the apparatus, and the location that contacts the bearing 20 on the circumferential face of the roller shaft 14*a* is always moves (during the rotation).

In this way, in accordance with the present invention, such relation is opposite to that of the carriage bearing structure described above, and the member that has the important functional element (that is, the roller shaft) is a moving member. Then, the contact location of the member (roller shaft) and the party that it deals with (bearing) in terms of elements is allowed to move at all times (in operation). As a result, it becomes possible for the roller shaft, which is the important functional element, to obtain a structure that is not easily affected by the frictional wearing or the like.

As described above, in accordance with each of the modes embodying the present invention, and each of the embodiments thereof, the bearing is provided with at least two contact portions to be in contact with the shaft portion of the roller, hence making it possible to element the degradation of the sheet conveyance precision due to the minute movement of rotating roller, and then, to attempt the enhancement of the sheet conveyance precision accordingly.

What is claimed is:

1. An image recording apparatus for recording images on a sheet comprising:

a main roller provided with a shaft portion;

a bearing for rotatably supporting said main roller through the shaft portion, said bearing being provided with at least two contact portions to be in contact with the shaft portion of said main roller, wherein said bearing encloses an entire periphery of the shaft portion and at least one of the two contact portions is curved;

a pinch roller for pinching the sheet in association with said main roller; and a spring for pressure-contacting said pinch roller with said main roller, wherein said pinch roller is pressure-contacted with said main roller so that the shaft portion is pressure-contacted with the two-contact portions, said pinch roller is pressure-contacted with said main roller so that there is a gap between a pinch roller side of the shaft and said bearing, and said bearing permanently encloses an entire periphery of a predetermined portion of the shaft portion.

2. An image recording apparatus according to claim 1, wherein at least one of the contact portions of said bearing to be in contact with the shaft portion of said main roller is a curved recessed portion having diameter larger than that of the shaft portion of said main roller.

3. An image recording apparatus according to claim 1, wherein at least one of the contact portions of said bearing to be in contact with said shaft portion of the roller is a flat plane portion.

4. An image recording apparatus according to claim 1, wherein at least one f the contact portions of said bearing to be in contact with said shaft portion of the roller is a curved convex portion.

5. An image recording apparatus according to claim 1, wherein at least one of the contact portions of said bearing is in contact with shaft portion of the roller contacts with the rear end of said shaft portion of said main roller in the sheet conveying direction.

* * * * *

UNITED STATES PATENT AND TRADEMARK OFFICE

CERTIFICATE OF CORRECTION

PATENT NO. : 6,769,683 B2
DATED : August 3, 2004
INVENTOR(S) : Soichi Hiramatsu

It is certified that error appears in the above-identified patent and that said Letters Patent is hereby corrected as shown below:

Column 3,
Line 26, “line B—B” should read -- 9—9 --.
Line 34, “line B—B” should read -- 12—12 --.

Column 6,
Line 65, “instable” should read -- unstable --.

Column 7,
Line 41, “portion” should read -- porting --.

Column 10,
Line 54, “is” should be deleted.

Column 12,
Line 14, “f” should read -- of --.

Signed and Sealed this

Twelfth Day of October, 2004

JON W. DUDAS
*Director of the United States Patent and Trademark Office*